United States Patent [19]

Komar

[11] 3,997,005

[45] Dec. 14, 1976

[54] METHOD FOR CONTROL OF SUBSURFACE COAL GASIFICATION

[75] Inventor: Charles A. Komar, Uniontown, Pa.

[73] Assignee: The United States of America as represented by the United States Energy Research and Development Administration, Washington, D.C.

[22] Filed: Oct. 23, 1975

[21] Appl. No.: 625,273

[52] U.S. Cl. ..... 166/251; 166/256; 166/245

[51] Int. Cl.[2] ..... E21B 43/24

[58] Field of Search ..... 166/259, 256, 271, 272, 166/251, 245, 248; 48/210, DIG. 6

[56] References Cited

UNITED STATES PATENTS

| | | | |
|---|---|---|---|
| 2,841,375 | 7/1958 | Salomonsson | 166/256 |
| 2,901,043 | 8/1959 | Campion et al. | 166/259 |
| 3,004,594 | 10/1961 | Crawford | 166/259 |
| 3,031,762 | 5/1962 | Parker | 166/245 X |
| 3,032,102 | 5/1962 | Parker | 166/251 |
| 3,113,619 | 12/1963 | Reichle | 166/245 |
| 3,132,692 | 5/1964 | Marx et al. | 166/245 |
| 3,154,142 | 10/1964 | Latta | 166/256 X |
| 3,933,447 | 1/1976 | Pasini et al. | 166/259 X |

*Primary Examiner*—Stephen J. Novosad
*Attorney, Agent, or Firm*—Dean E. Carlson; David S. Zachry; Earl L. Larcher

[57] ABSTRACT

The burn front in an in situ underground coal gasification operation is controlled by utilizing at least two parallel groups of vertical bore holes disposed in the coalbed at spaced-apart locations in planes orthogonal to the plane of maximum permeability in the coalbed. The combustion of the coal is initiated in the coalbed adjacent to one group of the bore holes to establish a combustion zone extending across the group while the pressure of the combustion supporting gas mixture and/or the combustion products is regulated at each well head by valving to control the burn rate and maintain a uniform propagation of the burn front between the spaced-apart hole groups to gasify virtually all the coal lying therebetween.

3 Claims, 1 Drawing Figure

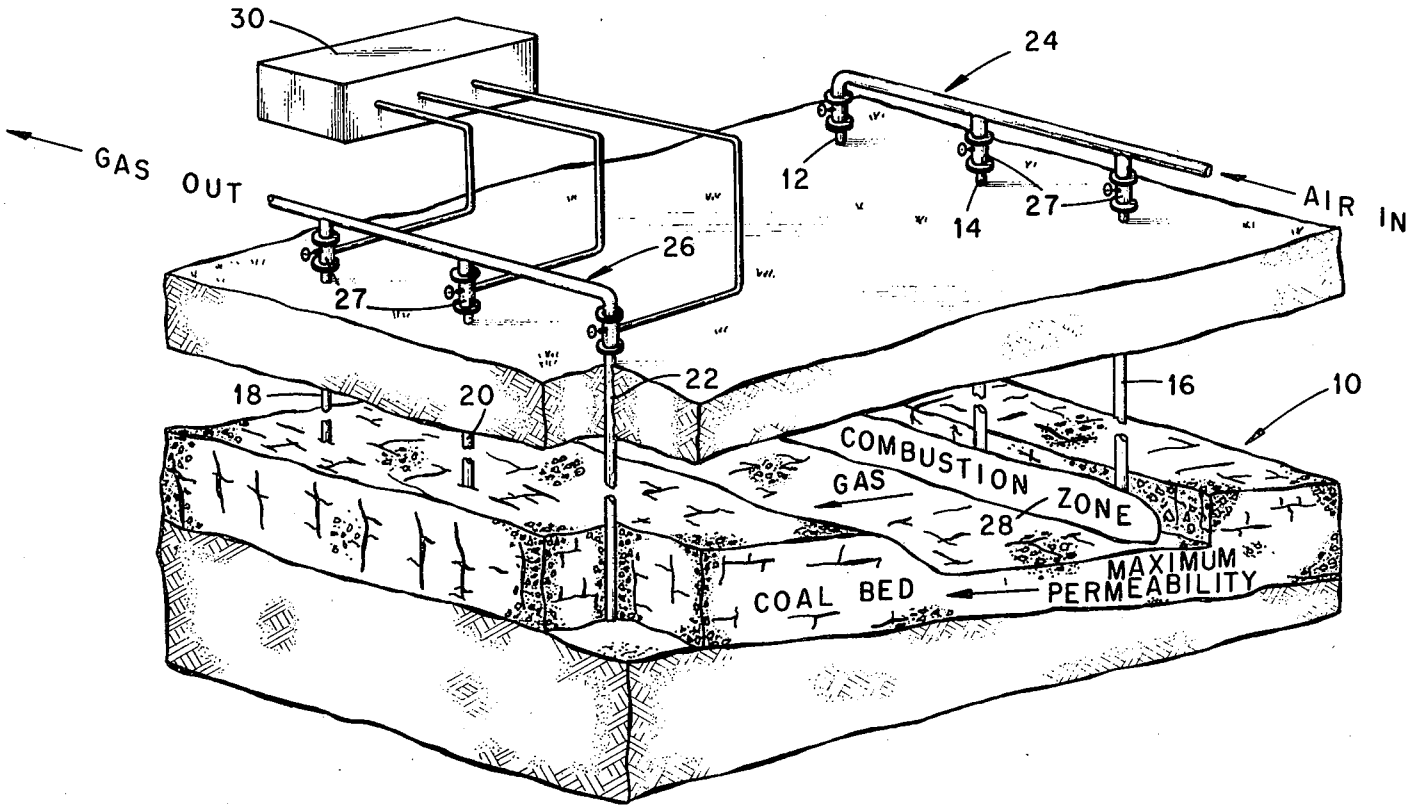
AIR IN
10
16
24
27
14
12
COMBUSTION ZONE
MAXIMUM PERMEABILITY
28
GAS
COAL BED
22
26
20
27
18
30
GAS OUT

METHOD FOR CONTROL OF SUBSURFACE COAL GASIFICATION

The present invention relates generally to in situ gasification of underground coalbeds and more particularly to selectively controlling the burn rate in the coalbed to provide a linear or uniform propagation of the combustion zone through the coalbed.

In situ gasification of coal has been a subject of considerable interest for effecting the recovery of energy and chemical values present in underground coalbeds without undergoing the considerable expense of shaft mining. Generally, in situ gasification by employing known shaftless (no underground mining) techniques involve providing access openings in the coalbed by drilling a number of bore holes to the bed, introducing a combustion supporting gas into the coalbed through all or selected bore holes, electrically or otherwise initiating the burning or combustion of the coal, and thereafter withdrawing the combustion product gases from the bed through selected bore holes or the same bore holes used to introduce the combustion supporting gas by employing concentric conduits. The combustion zones formed in the coalbeds at selected bore holes may be interconnected by a procedure known as electrolinking or by hydraulically or pneumatically fracturing the coalbed, followed by establishing a burn path between the combustion zones by "backward burning." The product gas recovered by in situ gasification of coal is usually relatively low Btu gas having a heating value in the range of about 100–300 Btu/cubic foot. The lower heat values may be obtained with air as the combustion supporting medium while higher heat values may be provided with oxygen-rich air as the combustion supporting medium. Steam may also be injected into the combustion zone to increase the hydrogen content of the product gas.

Recent studies have revealed that the natural fracture system existing in certain coals may be utilized for enhancing the withdrawal of gasification products or may be used for the conveyance of the combustion supporting gas to the combustion zone from an adjacent bore hole. For example, the natural fracture system appears to provide adequate permeability for the passage of the product gas or the combustion supporting gas through subterranean beds of lignite and subbituminous coal which exhibit an average permeability in the order of about 100 times greater than that found in bituminous coal. The directional path of the gas and the extent of the permeability of subterranean coalbeds can be readily determined by removing and inspecting oriented cores from selected bore holes penetrating the coalbed.

Utilization of the natural fracture system in coalbeds has provided an important tool for the economical in situ gasification of sub-surface coal. For example, the energy and chemical values resulting from the gasification of coal may be relatively easily recovered by drilling a selected number of vertical bore holes in the coalbed with the bore holes arranged in at least two groups, each group disposed along a plane orthogonal to the plane of maximum permeability of the coalbed and spaced apart from one another along a plane parallel to the maximum permeability in the coalbed, both planes as defined by the existing natural fracture system. Combustion of the coal in one group of the bore holes may then be initiated in any suitable manner, e.g., electrically, with the combustion supporting medium or gas being conveyed to the combustion zone from the other group of bore holes through the natural fracture system in the coalbed. The product gas resulting from the combustion of the coal is then removed through the group of bore holes in registry with the combustion zone. By employing such an arrangement, the combustion of the coal may be controlled by selectively varying the backpressure on certain bore holes conveying product gas to maintain the gas at a desired quality. Further, with the combustion supporting gas passing through the coalbed the growth of the combustion zone is a "reverse burn" towards the gas feed so as to provide a directional control factor which considerably improves the gasification efficiency for the coalbed being gasified.

The aforementioned technique of in situ gasification is believed to provide substantially better directional control of the combustion zone and control over the quality of the product gas than previously obtainable with vertical bore hole-type gasification technique. However, there is a drawback in this technique due to the lack of control over the configuration of burn front as it advances in a reverse burn towards the bore holes feeding the combustion supporting gas. More specifically, the propagation of the burn front from one group of bore holes to the second group of bore holes is not uniform and forms a combustion zone of a generally sawtooth or elliptical configuration. Such a configuration of the combustion zone results in an excessive amount of the coalbed being left essentially untouched since efficient gasification of the coalbed disposed between the bore hole groups continues only until interwell communication is established, i.e., the combustion zone spans the distance separating the two groups of bore holes.

Accordingly, it is the principal aim or goal of the present invention to obviate or substantially minimize the above and other drawbacks or shortcomings previously encountered in in situ gasification operations using vertical bore holes. The goal achieved by the method of the present invention is the uniform propagation of the combustion zone throughout the entire coalbed separating the two groups of vertical bore holes so as to gasify virtually all the coal existing in the coalbed between the well groups. This method is practiced by the steps of penetrating the coalbed with a first plurality of bore holes arranged in general alignment along a plane perpendicular to the plane of maximum permeabiity in the coalbed, penetrating the coalbed with a second plurality of bore holes arranged generally parallel to the first plurality of bore holes, but spaced therefrom a preselected distance along the plane of maximum permeability in the coalbed, initiating combustion of the coal at a location contiguous to the first plurality of bore holes, introducing combustion supporting gas into the combustion zone initiated at said location through said first plurality of bore holes, withdrawing the gaseous products of combustion from the second plurality of bore holes, and controlling the withdrawal of the gaseous products through selected bore holes of the second plurality of bore holes to vary the pressure drop between the combustion zone and the selected bore holes for providing a substantially uniform propagation of the combustion zone between the pluralities of bore holes.

Other and further objects of the invention will be obvious upon an understanding of the illustrative method about to be described, or will be indicated in the appended claims, and various advantages not referred to herein will occur to one skilled in the art upon employment of the invention in practice.

A schematic embodiment of the invention has been chosen for the purpose of illustration and description of the method and is not intended to be exhaustive or to limit the practice of the invention to the precise form disclosed. The drawing is chosen and described in order to best explain the method of the invention and its application in practical use to thereby enable others skilled in the art to best utilize the invention in various embodiments and modifications as are best adapted to the particular use contemplated.

IN THE ACCOMPANYING DRAWING

The FIGURE is a schematic perspective view showing a subterranean coalbed wherein in situ gasification in accordance with the teachings of the present invention may be practiced.

With reference to the drawing, a subterranean coalbed of sub-bituminous or lignite is shown generally at 10. This coalbed is, for the purpose of this invention, preferably in the range of about 400 to 1000 feet below the surface and about 30 to 200 feet in thickness. The energy and chemical values present in this coal may be extracted by gasification in situ. To effect this extraction in accordance with the method of the present invention, the coalbed is first penetrated with one or more vertical bore holes and an oriented core removed therefrom to determine the extent and direction of the natural fracture system present in the coalbed. In the event the coalbed exhibits sufficient permeability due to this natural fracture system to permit flow of a combustion supporting gas or the products of combustion therethrough over a length of several hundred feet, then the coalbed may be gasified in an economical manner by employing the teachings of the subject invention.

To effect in situ gasification of the coalbed several vertical bore holes are drilled to the coalbed and are then preferably cased and cemented in accordance with common practice. These bore holes shown generally at 12, 14, 16, 18, 20, and 22 are arranged in parallel groups of multiple bore holes. Each group of bore holes is disposed in general alignment along a plane perpendicular to the plane of maximum permeability in the coalbed and are disposed or spaced apart along this plane a distance in the range of about 100 to 200 feet from one another. The groups of multiple bore holes are, in turn, spaced from one another in a distance in the range of about 500 to 1000 feet determined by the permeability of the coalbed with this spacing being along a plane parallel to the plane of maximum permeability through the coalbed. As shown in the drawing, bore holes 12, 14, and 16 form one group 24 of bore holes while bore holes 18, 20, and 22 form the other group 26. While each of these groups is shown comprising three bore holes and while only two groups of bore holes are shown, it is to be understood that each group may consist of any desired number of bore holes and that several groups may be utilized, arranged in a serial manner.

Each bore hole is provided with a valve at the surface thereof, such as generally shown at 27, for controlling the flow of product gas or combustion supporting gas, e.g., air or an air-oxygen mixture containing 35 to 50 percent oxygen, through the respective bore holes and the coalbed. The combustion supporting gas is introduced through each bore hole at a flow rate which supports and maintains combustion of the coal so as to provide product gas of high heat value. Normally, a flow sufficient to provide a pressure of about 100–300 psig in the combustion zone is adequate to support underground combustion.

Upon completion of the vertical bore holes, the in situ gasification of the subterranean coalbed 10 may be initiated by establishing a combustion zone 28 in the coalbed at a location underlying the bore holes forming group 24. This combustion may be initiated electrically while the combustion supporting gas is introduced through the vertical bore holes 12, 14, and 16. Preferably, bore holes 12, 14, and 16 are interconnected, such as by electrolinking, or the like, for forming a combustion zone 28 spanning the entire space between the bore holes of group 24. The combustion proceeds as a "forward burn" towards the group 26 bore holes while the gas resulting from the combustion process passes through the fractures existing in the coalbed to the group 26 bore holes where the gas is withdrawn. The combustion zone enlarges in the direction towards the group 26 bore holes due to the drop in pressure caused by the extraction of the product gas through the bore holes 18, 20, and 22. In order to assure that the burn front of the combustion zone uniformly advances towards the group 26 bore holes the product gas extracted from each bore well 18, 20, and 22 is sampled to determine the gas composition and/or rate flow. For example, if the flow rate is greater than any one of the bore holes in the group 26, or the gas composition shows a low CO content relative to $CO_2$, then the portion of the burn front advancing towards that particular bore hole, as determined by the maximum permeability plane through the coalbed, is moving at a rate faster than the rate at adjacent portions of the burn front. To slow the burn rate at this particular portion of the coalbed to that of adjacent portions, the valve at that particular bore hole is manipulated to decrease the flow of the product gas therethrough which, in turn, reduces the burn rate of the combustion zone to that of adjacent portions of the combustion zone. Conversely, if the burn rate is found to be too slow as evidenced by a lower flow rate and a gas composition showing high CO content relative to $CO_2$, then the valve at the particular bore hole is manipulated to increase the pressure drop through the coalbed and thereby increase the flow rate to increase the burn rate in the portion of the coalbed in registry with that particular bore hole. In either event the selective adjustment of the flow through the product-gas-withdrawing bore holes selectively adjusts the pressure drop across the coalbed to assure that a linearly progressing combustion front exists throughout the entire coalbed interconnecting the bore hole groups. Normally, a pressure drop of about 20 psi is sufficient to cause the desired propagation of the burn front through a coalbed. In order to monitor the flow rate and analyze the combustion products, a suitable apparatus, such as shown at 30, is coupled to the individual bore holes 18, 20, and 22. This apparatus may include a simple flow meter for determining the flow rate through the valves as well as a combustion gas analyzer as known in the art to provide the functions necessary for determining the propagation of the burn front by monitoring the flow rate and combustion products at each individual bore hole.

It will be seen that the method of the present invention provides a significant improvement in the gasification of underground coalbeds in that the entire coalbed disposed between groups of vertical bore holes may be gasified so as to considerably increase the efficiency of the combustion process. Further, the selective controlling of the burn rate ensures that the product gas being extracted therefrom is of a desired Btu value, with this value being maintained throughout the entire gasification operation by the selective manipulation of the valves of the various bore holes.

What is claimed is:

1. A method for in situ gasifying a subterranean coalbed comprising the steps of penetrating the coalbed with a first plurality of bore holes arranged in general alignment and spaced apart from one another along a plane perpendicular to the plane of maximum permeabiity in said coalbed, penetrating the coalbed with a second plurality of spaced-apart bore holes arranged generally parallel to said first plurality of bore holes and spaced therefrom a preselected distance along a plane parallel to the maximum permeability of said coalbed, initiating combustion in said coalbed contiguous to said first plurality of bore holes, interconnecting the first plurality of bore holes in the coalbed to form a single combustion zone in registry with all of said first plurality of bore holes, introducing combustion supporting gas into said first plurality of bore holes at a rate sufficient to support and maintain the combustion zone, withdrawing gaseous products of combustion from said combustion zone through said second plurality of bore holes, and controlling the flow rate of gaseous combustion products being withdrawn through each bore hole of said second plurality of bore holes to selectively vary the pressure drop of the combustion products flowing between the combustion zone and each of said second plurality of bore holes to provide and maintain a uniform propagation of said combustion zone towards said second plurality of bore holes.

2. The method claimed in claim 1, wherein the coal is sub-bituminous or lignite, wherein the bore holes in each plurality of bore holes are spaced from one another a distance in the range 100 to 200 feet, and wherein each plurality of bore holes is spaced from one another a distance in the range of 500 to 1000 feet.

3. The method claimed in claim 1 wherein the step of controlling the flow rate of said combustion products through each of said second plurality of bore holes is determined by at least one of the flow rates and composition of the combustion products at each of said second plurality of bore holes.

* * * * *